United States Patent [19]

Kasamatsu et al.

[11] Patent Number: 4,743,580

[45] **Date of Patent: * May 10, 1988**

[54] HEAT-SENSITIVE RECORDING MATERIALS

[75] Inventors: Norikazu Kasamatsu, Kawasaki; Masao Matsukawa, Tokyo; Hirokazu Hirata, Kamifukuoka, all of Japan

[73] Assignee: Sanyo-Kokusaku Pulp Co., Ltd., Tokyo, Japan

[ * ] Notice: The portion of the term of this patent subsequent to Nov. 11, 2003 has been disclaimed.

[21] Appl. No.: 906,501

[22] Filed: Sep. 12, 1986

[30] Foreign Application Priority Data

Mar. 24, 1986 [JP] Japan ..... 61-63974

[51] Int. Cl.[4] ..... B41M 5/18

[52] U.S. Cl. ..... 503/214; 427/150; 427/151; 503/225

[58] Field of Search ..... 346/214; 427/150–152; 503/214, 225

[56] References Cited

U.S. PATENT DOCUMENTS 4,593,298 6/1986 Ikeda et al. ..... 346/200

4,622,566 11/1986 Kasamatsu et al. ..... 346/214

*Primary Examiner*—Bruce H. Hess

*Attorney, Agent, or Firm*—Oblon, Fisher, Spivak, McClelland & Maier

[57] ABSTRACT

A heat-sensitive recording material comprises a sheet substrate applied thereon with a heat-sensitive, color-developing layer containing as the main components a colorless or light-colored leuco dye, a developer for permitting said dye to develop a color by heating and a binder, in which the binder used is an ammonium salt of a diisobutylene/maleic anhydride copolymer is expressed in terms of the following general formula:

wherein R stands for a diisobutylene group a part of said ammonium salt being substituted and modified by an ammonium salt comprising a primary, secondary or tertiary ethanol amine.

3 Claims, No Drawings

HEAT-SENSITIVE RECORDING MATERIALS

BACKGROUND OF THE INVENTION

1. Field of the Invention

The present invention relates to a binder for heat-sensitive recording materials and, more specifically, to improvements in the water resistance of a coating layer of said recording materials and the storage stability of an undeveloped sheet portion.

2. Prior Art

Heat-sensitive recording materials are now enjoying wide use for output recording of facsimiles, electronic computers, automated ticket dispensers, medical examinations and the like as well as hard copying of CRT, partly because they can develope a clear image by heating and partly because they are advantageous in that the recorders used are relatively of a compact size and maintenance-free, the sheet substrate applied are usually paper which may be more inexpensive than other recording materials (e.g., dielectric recording sheets). Such heat-sensitive recording materials are obtained by applying onto a sheet substrate such as paper, a film or synthetic paper an aqueous solution or dispersion composed mainly of a colorless or light-colored leuco dye, a developer for allowing said dye to develope a color by heating and a binder, followed by drying. As the binders used to this end, it has been proposed to make use of water-soluble high-molecular compounds such as, for instance, polyvinyl alcohol or modified products, starch, or modified products and its derivatives, methylcellulose, hydroxyethylcellulose, carboxymethylcellulose, gelatin, casein, polyvinyl pyrrolidone, polyacrylamides, polyacrylates, styrene/maleic anhydride copolymers and diisobutylene/maleic anhydride copolymers, optionally with a waterproofing agent (formalin, glyoxal, chrome alum, glutar aldehyde, epoxy resins and melamine/formalin resins). It has also been proposed to use a hydrohobic resin, and high-molecular latices or emulsions of styrene/butadiene copolymers, polyvinyl acetate and polyacrylates ester. Whether they are water-soluble or added thereto with the waterproofing agent, however, such binders are poor in water resistance, and are troublesome in handling of said heat-sensitive recording sheets. For instance, when the heat-sensitive recording material is wetted by droplets of water or for some reasons, the coated layer may become sticky, or may peel from the sheet substrate. In addition, after recording, there may be a drop of the developed image density. In some cases, it may be impossible to make out the developed image. Use of the hydrohobic resin is disadvantageous in lowering of heat sensitivity and residue build-up. Some of the waterproofing agent with the water-soluble resin may cause the coagulation of the coating color which brings the coating trouble. Alternatively, there is a fear that ordinary low-temperature drying may lead to insufficient waterproofing (since drying at a temperature of higher than 100° C. may possibly incur color development, drying is usually carried out at a temperature not exceeding 100° C.). In view of the aforesaid considerations, attempts have been made to afford waterproofness to recording materials by various methods. However, none of these methods gives any satisfactory waterproofness. Even when the resulting materials have satisfactory waterproofness, they are found to have other shortcomings. For instance, the compound which is used as the waterproofing agent for the aforesaid water-soluble binders, and has in its molecule at least two 1,2-epoxy ring structures (Japanese Publication Patent No. 51-29947 or at least two ethylenimine groups (Japanese Laid-Open Patent No. 49-32646) gives rise to a lowering of heat sensitivity, which results in a drop of the developed image density and a drop of the stability of the coating liquid due to its coagulation or increases of viscosity, and brings about deteriorations in the storage stability of the heat-sensitive recording materials.

Japanese Laid-Open Patent Nos. 52-73047 and 54-1040 disclose an isobutylene/maleic anhydride copolymer, and Japanese Laid-Open Patent Nos. 54-80136 and 58-89397 teaches use of hydroxyethylcellulose and use of methylcellulose or carboxymethylcellulose with an isobutylene/maleic anhydride copolymer or its water-soluble salt, respectively. Although these compounds are found to give sufficient waterproofness to coated layer, they do not give any satisfactory brightness (of higher than 75%) to products which are formed into heat-sensitive recording sheets. Further, the brightness drops (to 70% or less) due to atmospheric moisture with the lapse of time, thus leading to deteriorations in the aesthetic appearance of the products to be used as recording sheets. Still further, when bar code pattern is recorded, there is a serious problem in which scaning becomes impossible.

SUMMARY OF THE INVENTION

An object of the present invention is therefore to solve the foregoing problems of the prior art binders and waterproofing agents. That is to say, this invention is concerned with a specific binder which brings sufficient water resistance of thermal coating layer accompanied with high brightness and its less reduction with storage time under atomospheric moisture.

In consequence of extensive and intensive studies made with a view to solving some problems as mentioned above, it has been found that a heat-sensitive recording material having sufficient water resistance and allowing an undeveloped portion to show a high brightness that does not substantially change with time is provided by a heat-sensitive recording material comprising a sheet substrate applied thereon with a heat-sensitive, color-developing layer containing as the main components a colorless or light-colored leuco dye, a developer for permitting said dye to develope a color by heating and a binder, in which the binder used is an ammonium salt of a diisobutylene/maleic anhydride copolymer is expressed in terms of the following general formula:

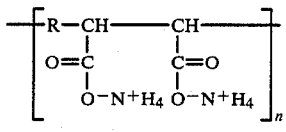

wherein R stands for a diisobutylene group.

A part of said ammonium salt being substituted and modified by an ammonium salt comprising a primary, secondary or tertiary ethanol amine (for instance, $H_3{+}NCH_2CH_2OH$, $(CH_3)_2H{+}NCH_2CH_2OH$, $H_2{+}N(CH_2CH_2OH)_2$, $(CH_3)H{+}N(CH_2CH_2OH)_2$, $H{+}N(CH_2CH_2OH)_3$, etc.).

DETAILED DESCRIPTION OF THE PREFERRED EMBODIMENTS

For instance, the leuco dyes used in the present invention usually include the following colorless or slightly colored, lactone, lactam or spiropyram base dyses:

Crystal violet lactone
Malachite green lactone
3,3-bis(P-dimethylphenyl)-6-aminophthalide
3,3-bis(P-dimethylaminophenyl)-6-P-toluene sulfoneamide
3-dimethylamino-6-methoxyfluoran
3-diethylamino-6-methyl-7-chlorofluoran
3-dibutylamino-6-methyl-7-chlorofluoran
3-dimethylamino-6-methyl-7-phenylaminofluoran
3-dibutylamino-7-orthofluoroanilinofluoran
3-dimethylamino-7-(N-methyl-P-toluidino)fluoran
3-diethylamino-7-benzylaminofluoran
3-methyl-di-β-naphtospiropyran.
benzo-β-naphtospiropyran As the developers used in the present invention, use may be made of any substances capable of being liquefied or gasified at a temperature exceeding normal temperature, preferably higher than 70° C. and reacting with the color-developing dye for color development, which include, for instance, acidic organic substances:

4-4'-isopropylidenediphenol (bisphenol A)
4-4'-isopropylidene bis(2-chlorophenol)
4-4'-isopropylidene bis(2-methylphenol)
4-4'-isopropylidene bis(2-tert.-butylphenol)
Bis-(P-hydroxyphenyl) sulfone
Bis-(2,5-dimethyl-4-hydroxy) sulfone
4-tert.-butylphenol
4-tert.-octylphenol
4-phenylphenol (P-phenylphenol)
4-hydroxydiphenoxide
β-naphtol
Methyl-4-hydroxybenzoate
Benzyl-4-hydroxybenzoate
4-hydroxyacetophenol; and the following acidic inorganic substances:
Silica
Bentonite.

As is the case with the leuco dyes, however, the present invention is not exclusively limited to the above exemplified substances.

The heat-sensitive color-develping layer according to the present invention may contain the following various substances, if required, in addition to the aforesaid leuco dye, acidic substances and binders. For instance, use may be made of white pigments such as talc, clay, silica or titanium oxide for the purpose of further improving writ ability, brightness and sticking; various thermoplastic substances such as various waxes, metal salts of higher fatty acids or higher fatty acid amides for the purpose of further improving image quality and sticking and inhibiting color-development under pressure; and dispersants, wetting agents and anti-foaming agents for the purpose of improving dispersity and coatability of coating color.

The heat-sensitive recording materials according to the present invention may be prepared by any conventionally used methods. For example, of the aforesaid components, the leuco dye and the color-developing agent are at least separately pulverized and dispersed by means of a dispersing device such as a ball mill, an attritor or a sand mill, until a dispersion particule size of 1 to 3 microns is obtained. Thereafter, the resulting particulate product is formulated according to the given recipe, thereby preparing a liquid to define a heat-sensitive, color-developing layer. Then, that liquid is applied and dried on a sheet substrate formed of, e.g., paper, a film or synthetic paper, and calendering gives the heat-sensitive recording material according to the present invention.

In the following, consideration will now be given to the reasons why the effects as mentioned above are attained by the present invention.

I. WATER RESISTANCE

The reason why improvements in water resistance are achieved is that the aforesaid compounds remain in the form of the water-insoluble diisobutylene/maleic anhydride copolymer through volatilization of ammonia by drying in the course of formation of said heat-sensitive, color-developing layer.

II. IMPROVEMEHTS IN BRIGHTNESS

Such improvements are considered to be attained by the color-developing reaction of the leuco dye with carboxylic acid from the fact that the aforesaid compounds are dissociated in an aqueous solution into carboxylic acid and ammonium hydroxide and, even after the application and drying of a coating liquid for forming the heat-sensitive, color-developing layer containing the binder, the ammonium salt remains so that the aforesaid reaction proceeds gradually with atmospheric moisture to set free the carboxlyic acid. Accordingly, when a part of the ammonium salt is substituted by a primary, secondary or tertiary ethanol amine, the aforesaid dissociation reaction is considered to be inhibited, so that the high brightness of the undeveloped portion is kept, and does not substantially change with time.

As the binder in the present invention, it is possible to use the ammonium type containing the ethanol amine of diisobutylene/maleic anhydride copolymers alone or in combination with other binders, if required, which may include a water-soluble resin such as polyvinyl alcohol or starch, and latices and emulsions of styrene/butadiene copolymers. However, it is required that the binder used be composed mainly of said water-soluble salt of diisobutylene/maleic anhydride copolymers for the purpose of the present invention.

EXAMPLES

In the following, the present invention will now be explained in further detail with reference to the following examples.

Examples 1~5

The following respective components were dispersed for 24 hours with the use of a ball mill to prepare dispersion liquids A to C.

| | Parts by Weight |
|---|---|
| Liquid A | |
| 3-dibutylamino-7-orthofluoroanilinofluoran | 1.0 |
| 20% polyvinyl alcohol | 5.0 |
| water | 44.0 |
| Liquid B | |
| 4-4'-isopropylidenediphenol | 4.0 |
| calcium carbonate | 3.0 |
| stearamide | 1.0 |
| 20% polyvinyl alcohol | 10.0 |
| water | 32.0 |

-continued

| | Parts by Weight |
|---|---|
| Liquid C | |
| Bis-(P—hydroxyphenyl)sulfone was used in place of 4-4'(isopropylidenediphenol in Liquid B; and the remaining components were the same as in B. | |

Subsequently, the liquids A and B or C were mixed with 10.0 weight parts of the 20 solid % binder that was a liquid D, E or F comprising ammonium salt of a diisobutylene/maleic anhydride copolymer, 25% of which use substituted by monoethanolamine, diethanolamine or triethanolamine respectively as shown in Table 1, and the resulting mixture was applied on one side of wood free paper (having a basis weight of 50 g/m$^2$) to form a heat-sensitive, color-developing film in a coated amount of 5–7 g/m$^2$, thereby obtaining the heat-sensitive recording sheet according to the present invention.

TABLE 1

| | Mixing Recipe | | |
|---|---|---|---|
| Example 1 | Liquid A | Liquid B | Liquid D |
| Example 2 | Liquid A | Liquid C | Liquid D |
| Example 3 | Liquid A | Liquid C | Liquid E |
| Example 4 | Liquid A | Liquid B | Liquid F |
| Example 5 | Liquid A | Liquid C | Liquid F |

Comparative Examples 1 and 2

Example 1 use repeated, except that as the binder use was made of 10.0 weight parts of an ammonium salt of a diisobutylene/maleic anhydride copolymer or 10.0 weight parts of 20% polyvinyl alcohol, thereby to obtain control heat-sensitive recording materials.

Then, the thus obtained seven heat sensitive recording sheets were printed by means of a label printer (HP-9303, manufactured by Tokyo Denki Kabushiki Kaisha), whereby the testing in connection with color-developing properties, residue build-up, sticking, water resistance and brightness of the sheet substrate were carried out. The results are set forth in Table 2. It is noted that the testing methods applied are as follows.

CONCENTRATION OF COLOR DEVELOPMENT

The density of the color-developed portion obtained with a label printer was measured with a Macbeth densitometer RD-514.

Water Resistance 1

The color-developed portion obtained with a label printer was immersed in water at normal temperature and, after 24 hours, the density thereof was measured with a Macbeth densitometer RD-514.

Water Resistance 2

Water was added dropwise onto the heat-sensitive, color-developing layer, which was then rubbed with fingers to examine tackiness and detraction of the coated layer.

Brightness

The whiteness of the undeveloped portion was measured with a Hunter Brightness Tester.

Moisture Resistance

The sample was allowed to stand for 24 hours at 40° C. and 93% RH to measure the brightness of the undeveloped portion.

TABLE 2

| | Density of Developed Image | Residue Build-up Sticking | Brightness (%) | Moisture Resistance (%) | Water Resistance 1 | Water Resistance 2 |
|---|---|---|---|---|---|---|
| Example 1 | 1.30 | O | 77 | 75 | 1.25 | O |
| Example 2 | 1.29 | O | 78 | 75 | 1.25 | O |
| Example 3 | 1.29 | O | 79 | 76 | 1.24 | O |
| Example 4 | 1.31 | O | 79 | 76 | 1.24 | O |
| Example 5 | 1.30 | O | 80 | 76 | 1.23 | O |
| Comparative Example 1 | 1.29 | O | 72 | 60 | 1.26 | O |
| Comparative Example 2 | 1.31 | O | 79 | 75 | 0.50 | X |

As shown in Table 2, the heat-sensitive recording materials of the present invention excel in the color-developing properties, and the undeveloped portions thereof had a high degree of brightness. The printed images hardly discolored in water, and the degree of whiteness hardly deteriorated during storage. However, Comparative Example 1 was so poor in moisture resistance that the brightness dropped in water with time. Referring to Comparative Example 2, the coated layer exhibited no water resistance at all, and the printed image discolored in water to such an extent that it was illegible.

We claim:

1. A heat-sensitive recording material comprising a sheet substrate applied thereon with a heat-sensitive, color-developing layer containing as the main components a colorless or light-colored leuco dye, a developer for permitting said dye to develope a color by heating and a binder, in which the binder used as an ammonium salt of a diisobutylene/maleic anhydride copolymer is expressed in terms of the following general formula:

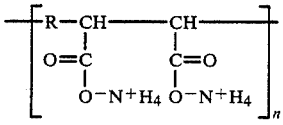

wherein R stands for a diisobutylene group, a part of said ammonium salt being substituted and modified by an ammonium salt comprising a primary, secondary or tertiary ethanol amine.

2. A heat-sensitive recording material comprising a sheet substrate applied thereon with a heat-sensitive, color-developing layer containing as the main components a colorless or light-colored leuco dye, a developer for permitting said dye to develop a color by heating and a binder, in which the binder used is an ammonium salt of a diisobutylene/maleic anhydride copolymer as expressed in terms of the following general formula:

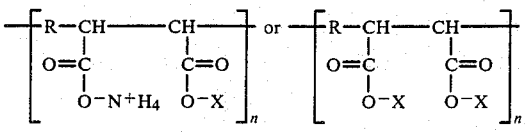
wherein
R stands for a diisobutylene group, and
X stands for a primary, secondary or tertiary ethanol amine.
3. The recording material of claim 2, wherein X stands for an ethanol amine selected from the group consisting of $R^{+}{}_{3}NCH_2CH_2OH$, $(CH_3)_2H^{+}NCH_2CH_2OH$, $H_2{}^{+}N(CH_2CH_2OH)_2$, $(CH_3)H^{+}N(CH_2CH_2OH)_2$ and $H^{+}N(CH_2CH_2OH)_3$.
* * * * *